US006321433B1

(12) United States Patent
Cliff et al.

(10) Patent No.: US 6,321,433 B1
(45) Date of Patent: Nov. 27, 2001

(54) DOUBLE BEVEL PREWINDER MANDREL

(75) Inventors: Graeme J. Cliff, Malvern East; Rodney D. Bolt, Nunawading, both of (AU)

(73) Assignee: Fairchild Holding Corporation, Dulles, VA (US)

( * ) Notice: Subject to any disclaimer, the term of this patent is extended or adjusted under 35 U.S.C. 154(b) by 0 days.

(21) Appl. No.: 09/160,620

(22) Filed: Sep. 24, 1998

(51) Int. Cl.[7] ..... B23P 19/04
(52) U.S. Cl. ..... 29/240.5; 29/240
(58) Field of Search ..... 29/240.5, 240

(56) References Cited

U.S. PATENT DOCUMENTS

| | | | | |
|---|---|---|---|---|
| 2,745,457 | | 5/1956 | Lang . | |
| 3,052,972 | * | 9/1962 | Steinmayer | 29/240.5 |
| 3,093,895 | | 6/1963 | Eddy . | |
| 3,111,751 | * | 11/1963 | Eddy | 29/240.5 |
| 3,348,293 | * | 10/1967 | Newton | 29/240.5 |
| 3,602,975 | | 9/1971 | Thurston . | |
| 3,983,736 | | 10/1976 | King, Jr. . | |
| 4,172,314 | * | 10/1979 | Berecz | 29/240.5 |
| 4,536,115 | | 8/1985 | Helderman . | |
| 4,712,955 | | 12/1987 | Reece et al. . | |
| 4,980,959 | * | 1/1991 | Czarnowski | 29/240.5 |
| 5,456,145 | * | 10/1995 | Consenza | 29/240.5 |

FOREIGN PATENT DOCUMENTS 0 438 965 A2 11/1990 (EP) .

* cited by examiner

*Primary Examiner*—Joseph J. Hail, III
*Assistant Examiner*—Daniel Shanley
(74) *Attorney, Agent, or Firm*—Lyon & Lyon LLP

(57) ABSTRACT

A prewinder mandrel including an elongate shaft having a threaded lead end, a slot dividing the lead end into first and second end portions, and a pair of opposing beveled edges on the first end portion. A first drive edge is located between the first and second beveled edges, a second drive edge is located on an outer edge of the second end portion, and an inclined ramp extends along the second end portion from the leading edge towards the slot. The mandrel may part of a prewinder tool for installing helical wire inserts that includes a drive mechanism coupled to the mandrel shaft and a threaded nozzle through which the shaft extends. The shaft includes a threaded intermediate region for engaging the threaded nozzle to drive the mandrel at a predetermined pitch. The lead end is inserted into a wire insert, the shaft rotated to advance the insert over the lead end until the tang engages a first beveled edge and is seated within the slot. The lead end is directed into a tapped hole and the shaft rotated to wind the insert into the hole. The shaft is then rotated in reverse, a second beveled edge and the inclined ramp slidably disengaging the tang from the slot, and the lead end is withdrawn from the hole while leaving the insert in place.

25 Claims, 5 Drawing Sheets

DOUBLE BEVEL PREWINDER MANDREL

FIELD OF THE INVENTION

The present invention relates generally to tools for helically coiled wire inserts, and more particularly to prewinder mandrels and tools for installing tanged helically coiled wire inserts.

BACKGROUND

Helically coiled wire inserts are often used when fasteners are being fastened into relatively soft parent materials. For example, a wire insert may be introduced into a tapped hole in a relatively soft parent material, such as aluminum, to substantially reduce the risk of stripping the hole when a relatively hard fastener, such as a steel bolt, is received therein. Wire inserts are generally formed from a single length of wire that is wound into a helical shape, thereby defining a cylindrical channel including an internal and an external thread pattern. One end of the wire insert may include a tang, generally formed by bending one end of the length of wire substantially transversely across the cylindrical channel.

To install wire inserts, a prewinder tool may be used onto which a wire insert may be received prior to insertion into a tapped hole. For example, FIGS. 1–2C show a prewinder mandrel 10 for a prewinder tool (not shown) that includes a threaded lead end 12 terminating in a lead tip 14. A slot 16 is provided across the lead tip 14 for receiving a tang from a wire insert (not shown) therein. The slot 16 divides the lead tip 14 into a first end portion 22 having a helical bevel 24 defined by the thread pattern 20, and a second end portion 26 having an inclined ramp 28 and a leading edge 32. The prewinder tool includes a threaded nozzle (not shown) through which the mandrel 10 may extend, and the nozzle and mandrel 10 may include cooperating thread patterns for driving the mandrel 10 at a predetermined pitch.

To wind a wire insert onto the mandrel 10, the mandrel 10 is rotated about its longitudinal axis with respect to the wire insert, and the lead tip 14 is directed into the open end of the wire insert, through the cylindrical channel and towards the tang. The thread pattern of the lead end 12 substantially engages the internal thread pattern of the wire insert, generally compressing the wire insert radially as it is advanced over the lead end 12. When the lead tip 14 passes through the cylindrical channel, the tang of the wire insert 10 (not shown) is engaged by the leading edge 32 of the lead tip 14 and enters the slot 16, thereby fixing the wire insert on the lead end 12.

The lead end 12 may then be introduced into a tapped hole (not shown), and the mandrel 10 rotated further to direct the wire insert into the tapped hole, the external thread pattern of the wire insert cooperating with a thread pattern of the tapped hole. Once the wire insert is fully received in the tapped hole, the rotation of the mandrel 10 may be reversed, the wire insert unwound from the lead end 12, and the lead end 12 withdrawn from the tapped hole, leaving the wire insert therein. As the mandrel 10 is being rotated to unwind the wire insert, the tang may slide along the inclined ramp 28 and out of the slot 16.

One of the problems often associated with conventional prewinder mandrels is improper seating of the tang within the slot as the wire insert is wound onto the lead end. During use, a force is generally applied tangentially between the mandrel and the wire insert, e.g., along their cooperating thread patterns, to wind the wire insert onto the lead end and to insert the wire insert into a tapped hole. The substantial loads transferred between the mandrel and the wire insert may create risks of damage to the nozzle of the tool, the mandrel, individual inserts, and/or the tapped hole unless precise tolerances are maintained.

In addition, because the leading edge is generally higher than the remaining portions of the lead end, it may result in the tang being picked up too early by the slot. This may cause the tang to bend outward, may distort the shape of the wire insert, may increase the diameter of the tang end and/or may even cause the tang to break, substantially increasing the risk of jamming or cross-threading in the nozzle and/or in the tapped hole.

Furthermore, the leading edge may result in single point contact between the tang and the lead tip. If the geometry of this contact is altered, for example, due to poor mandrel or tool manufacture, wear or damage to the mandrel or tool, variation in wire insert shape, variation in tapped hole geometry, and the like, the load transfer between the mandrel and the insert may be altered significantly, and problems similar to those described above may occur.

Accordingly, there is a need for improved prewinder mandrels and/or tools for installing helically coiled wire inserts.

SUMMARY OF THE INVENTION

The present invention is directed to mandrels and tools for installing helically coiled wire inserts, and to methods of installing wire inserts using such tools. Wire inserts are generally a helically wound length of wire defining a passage therethrough and including a tang extending substantially transversely across one end of the passage opposite an open end of the passage. Wire inserts generally include an outer thread for cooperating with a tapped hole and an inner thread for cooperating with a fastener being received in the tapped hole.

In one aspect of the present invention, a prewinder mandrel is provided that includes an elongate shaft defining a longitudinal axis and having a threaded first end and a second end. A slot extends substantially transversely across the first end, thereby dividing the first end into first and second end portions. A pair of opposing beveled edges are provided on the first end portion, the beveled edges sloping away from each other and towards the second end of the elongate shaft.

Preferably, the slot includes first and second drive edges for engaging a tang of a wire insert received on the first end, the first drive edge being located between the first and second beveled edges, the second drive edge being located on an outer edge of the second end portion. In addition, the first end portion may include an intermediate surface between the opposing beveled edges defining a plane substantially normal to the longitudinal axis of the elongate shaft.

The second end portion preferably defines first and second outer edges adjacent the slot, and preferably includes an inclined ramp extending between the first and second outer edges, the inclined ramp being inclined generally into the slot. The first outer edge preferably provides a drive edge for engaging a tang of a wire insert received on the first end, and the inclined ramp is preferably inclined from the first outer edge towards the second outer edge and towards the second end of the elongate shaft.

The mandrel may also include a drive head on the second end of the elongate shaft, and an enlarged, preferably threaded, region adjacent the threaded first end. The mandrel may also include a nozzle having an axial passage therethrough through which the shaft may extend. The axial passage preferably includes a threaded portion therein for cooperating with the threaded enlarged region of the elongate shaft for directing the elongate shaft axially with respect to the nozzle at a predetermined pitch.

The mandrel and nozzle may be included as part of a tool for inserting a wire insert, in accordance with another aspect of the present invention. The tool may include an elongate shaft having a first threaded end and defining a longitudinal axis, and a drive mechanism, preferably a pneumatic motor, for rotating the elongate shaft about the longitudinal axis. A slot may extend substantially transversely across the first end, thereby dividing the first end into first and second slot portions, and a pair of opposing beveled edges may be provided on the first slot portion. The beveled edges preferably slope away from each other and towards the second end of the elongate shaft, as described above for the prewinder mandrel.

In a preferred form, the elongate shaft is detachable from the drive mechanism, and the elongate shaft has a drive head on a second thereof. The drive mechanism and the drive head preferably include cooperating connectors for detachably securing the elongate shaft to the drive mechanism. The elongate shaft also preferably includes a threaded, and preferably enlarged, intermediate region adjacent the threaded first end, and the drive mechanism includes a nozzle through which the elongate shaft extends. The nozzle preferably includes a threaded region for cooperating with the threaded intermediate region of the elongate shaft for driving the elongate shaft forward or backward along the longitudinal axis with respect to the drive mechanism, preferably at a predetermined pitch.

In another aspect of the present invention, a method for inserting a wire insert into a hole in a parent material is provided that uses a prewinder tool including a shaft defining a first end, a slot extending across the first end to divide the first end into first and second end portions defining first and second leading edges, respectively, and a first inclined ramp adjacent the first leading edge. The first end of the shaft is inserted into the open end of a wire insert, and the shaft is rotated about its longitudinal axis, thereby advancing the wire insert over the first end until a tang on the wire insert engages the first inclined ramp. The shaft is rotated further in the first direction to seat the tang within the slot, the first inclined ramp having a predetermined incline angle and height offset with respect to the second leading edge such that the tang is seated within the slot in a predetermined orientation, and the wire insert is fully received on the first end.

In a preferred form, the wire insert is radially compressed as it is advanced over the first end of the shaft, thereby reducing the diameter of the wire insert to facilitate installation. The wire insert may then be inserted into a bored, preferably threaded hole, in a relatively soft parent material, such as aluminum. The first end of the shaft, with the wire insert thereon, may be directed into the hole, and the shaft rotated about its longitudinal axis in a first direction, thereby cooperatively engaging the wire insert and the hole.

The shaft may then be rotated about its longitudinal axis in a direction opposite the first direction, thereby withdrawing the first end of the shaft from the hole while leaving the wire insert within the hole. The first end portion of the shaft preferably defines a trailing edge, including a second inclined ramp thereon, the second inclined ramp slidably engaging the tang to facilitate disengagement of the tang from the slot as the first end of the shaft is withdrawn from the hole. The second end portion may also define a trailing edge, and including a third inclined ramp thereon for further facilitating disengagement of the tang.

Thus, a "double bevel" mandrel in accordance with the present invention may include a first inclined ramp adjacent a leading edge of a slot in the lead tip of the mandrel, and a second inclined ramp adjacent a trailing edge of the slot. The first inclined ramp may slidably engage a tang of an insert being received on a lead end of the mandrel when the mandrel is rotated in a forward direction, and the second inclined ramp may then slidably disengage the tang from the slot when the mandrel is rotated in the reverse direction. The inclined ramps may have a predetermined orientation with respect to one another and/or with respect to another leading edge of the lead tip, e.g., may include predetermined incline angles. Thus, the double bevel arrangement may facilitate receiving and disengaging the tang within the slot in a manner that minimizes variations in the forces being transferred during prewinding and/or installation of a wire insert, and/or may substantially reduce the risk of damage to the components involved.

Other objects and features of the present invention will become apparent from consideration of the following description taken in conjunction with the accompanying drawings.

DETAILED DESCRIPTION OF THE PREFERRED EMBODIMENTS

Figure 1:
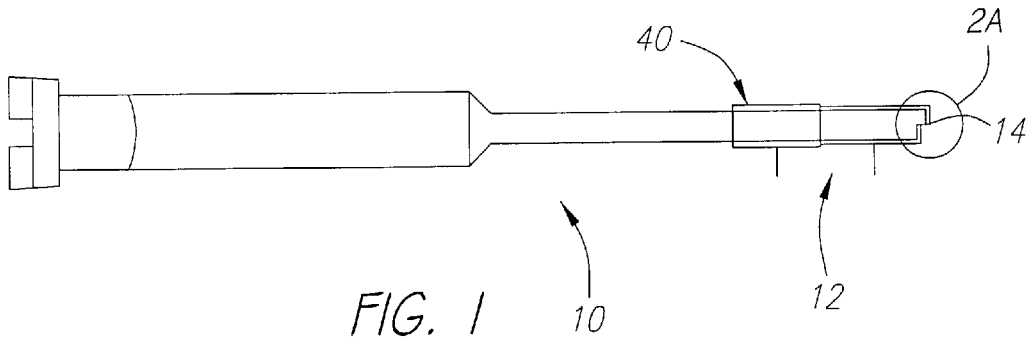
FIG. 1 (PRIOR ART)
FIG. 1 is a side view of a prior art prewinder mandrel.
Figure 2A:
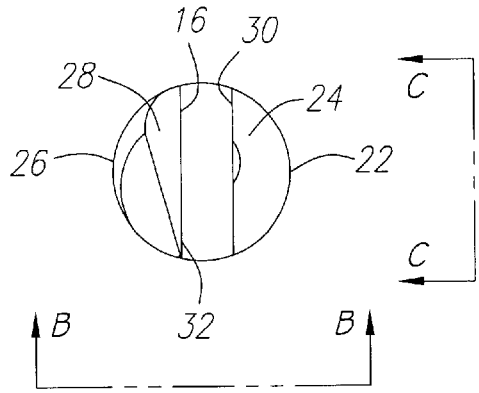
FIG. 2A (PRIOR ART)
FIG. 2A is a details of the lead end of the prior art prewinder mandrel of FIG. 1.
Figure 2B:
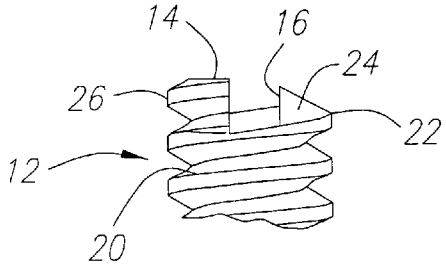
FIG. 2B (PRIOR ART)
FIGS. 2B and 2C are side views of the lead end of FIG. 2A, taken along lines B—B and C—C, respectively.
Figure 2C:
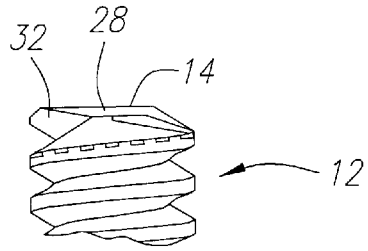
FIG. 2C (PRIOR ART)
Figure 3:
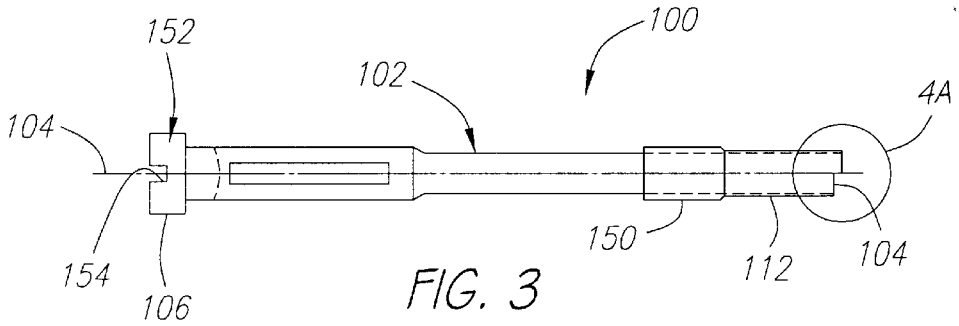
FIG. 3 is a side view of a mandrel for a prewinder tool, in accordance with one aspect of the present invention.
Figure 4A:
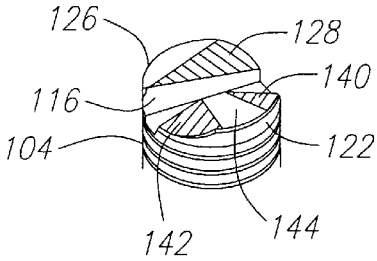
FIG. 4A is a perspective view of the lead end of the mandrel of FIG. 3.
Figure 4B:
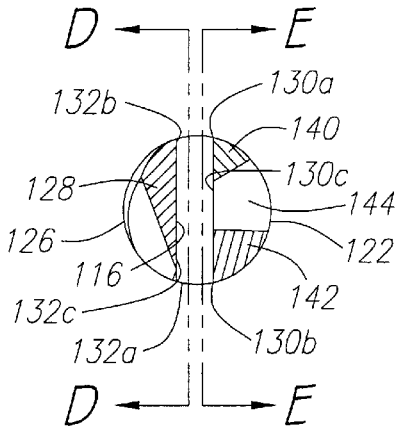
FIG. 4B is a detailed end view of the lead end of the mandrel of FIG. 3.
Figure 4C:
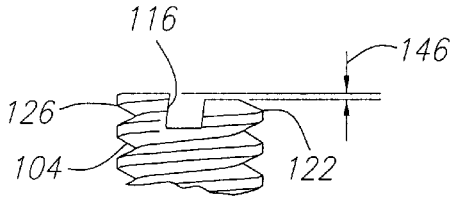
FIG. 4C is a detailed side view of the lead end of the mandrel of FIG. 3.
Figure 4D:
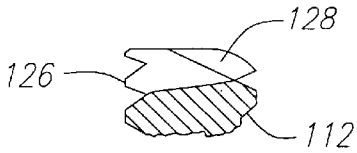
FIGS. 4D and 4E are cross-sectional details along lines D—D and E—E of FIG. 4B, respectively.
Figure 4E:
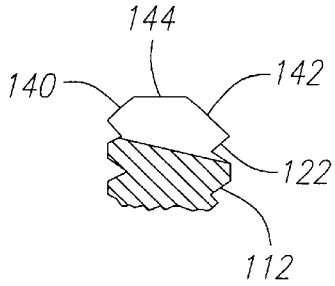

Turning now to the drawings, FIGS. 3–4E show a preferred embodiment of a mandrel 100 for a prewinder tool (not shown), in accordance with one aspect of the present invention. The mandrel 100 includes an elongate, preferably cylindrical, shaft 102 defining a longitudinal axis 104, and having a threaded first or lead end 112 that terminates in a lead tip 114, and a second or drive end 106.

As shown in FIG. 4A–4C, a slot 116 extends substantially transversely across the lead tip 114, substantially dividing the lead tip 114 into first and second end portions 122, 126. The first end portion 122 includes a "double bevel," i.e., a pair of opposing beveled edges or first and second inclined ramps 140, 142. The first and second inclined ramps 140, 142 are preferably located at opposite ends of the slot 116, thereby defining an intermediate surface 144 therebetween that extends substantially normal to the longitudinal axis 104. Each inclined ramp 140, 142 is sloped away from the lead tip 114, i.e., the inclined ramps 140, 142 preferably slope "downward" away from each other and towards the drive end 106, as shown in FIG. 4E.

As shown in FIG. 4B, the lead end 112 includes a redetermined thread pattern such that the first and second end portions 122, 126 preferably define opposing first and second leading edges 130*a*, 132*a*, respectively, and first and second trailing edges 130*b*, 132*b*, when the cylindrical shaft 102 is rotated in a first or forward direction about the longitudinal axis 104. For example, the lead end 112 shown defines the forward direction when the mandrel 100 is rotated about the longitudinal axis 104 counterclockwise, as viewed from the lead tip 104 or FIG. 4B. The first inclined ramp 140 has a predetermined ramp angle and the intermediate surface 144 has a predetermined height offset 146 with respect to the second leading edge 132a such that the slot 116 defines first and second drive edges 130*c*, 132*c*.

The second end portion 126 includes a third inclined ramp 128, which extends between the leading edge 132*a* and the trailing edge 132*b*, and is generally inclined into the slot 116. More preferably, the third inclined ramp 128 is inclined "downward" from the leading edge 132*a*, i.e., towards the trailing edge 132b and the drive end 106, as shown in FIG. 4D.

As best seen in FIG. 4A, the inclined ramps 140, 142, 128 and end portions 122, 126 are machined to high tolerances such that the tang of a wire insert received on the lead end 112 will be seated and released in a precise fashion, minimizing the risk of bending the tang, increasing the diameter of the wire insert, or other distortion or damage to the wire insert. The incline angles and height offset dimensions are preferably set to correspond to the dimensions of the wire insert and/or to the thread pattern of the lead end 112.

For example, as shown in FIG. 4C, the predetermined height offset 146 of the first and second end portions 122, 126, preferably about 0.008 inch, may facilitate substantially simultaneous pick up of the tang by the first and second drive edges 130*c*, 132*c* when the mandrel 100 is rotated in the forward direction, thereby causing the tang to be received in the slot 116 in a predetermined orientation. In addition, the first inclined ramp 140 may have a predetermined ramp angle, preferably about 30°, such that the tang may slidably engage the first inclined ramp 140 until the tang is properly picked up by the first and second drive edges 130*c*, 132*c*.

When the mandrel 100 is rotated in a reverse direction, e.g., clockwise as viewed from the lead tip 114, the predetermined incline angles of the second and third incline ramps 142, 128 may facilitate the disengagement of the tang from the slot 116 after the wire insert on the lead end 112 has been installed in the tapped hole. In a preferred form, the second and third incline ramps have incline angles of about 22.3° and about 26.4°, respectively.

Figure 5:
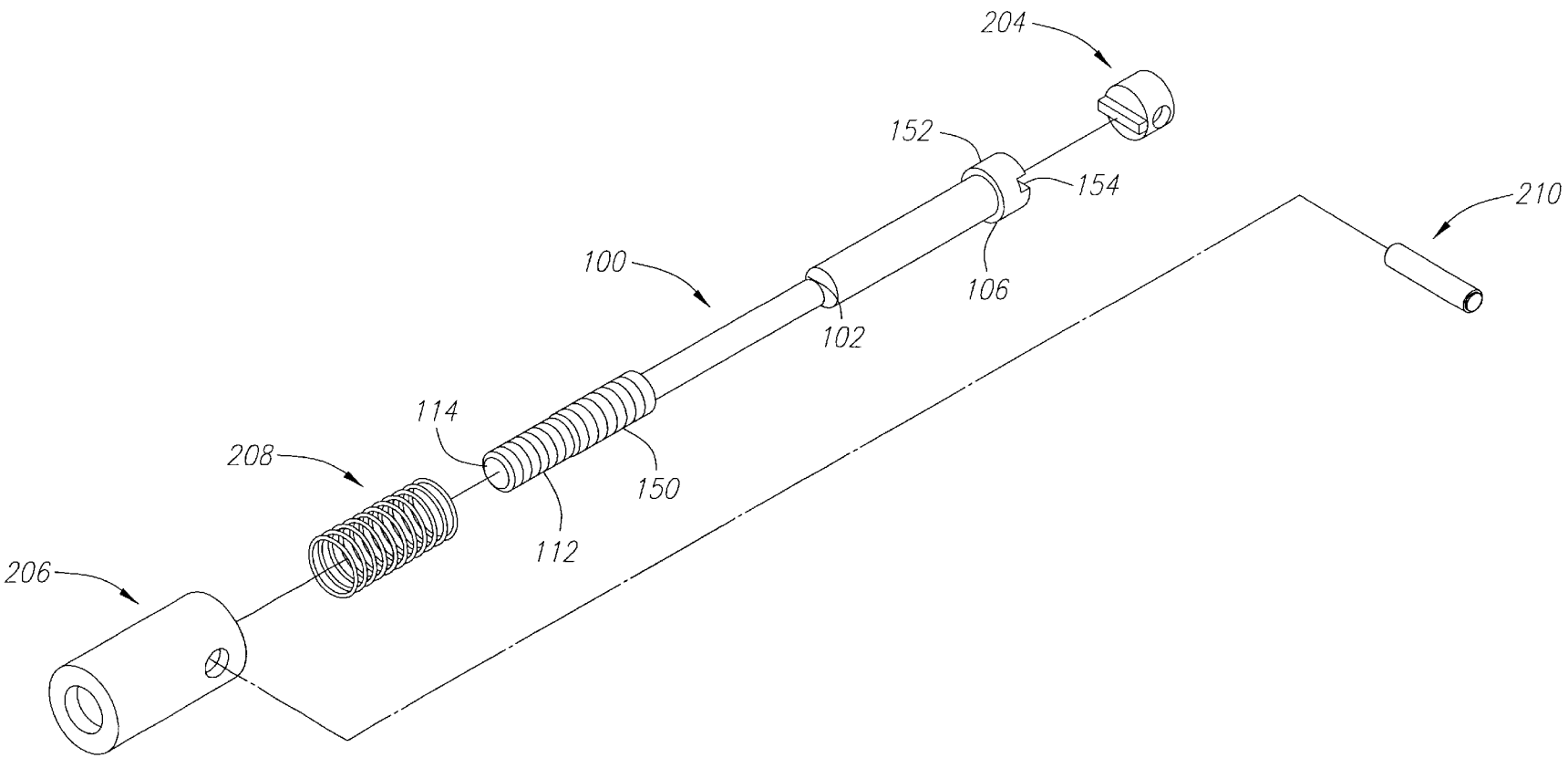
FIG. 5 is an exploded perspective view a prewinder mandrel and components for connecting the prewinder mandrel to a prewinder tool, in accordance with the present invention.

As best seen in FIGS. 3 and 5, the mandrel 100 may also include an enlarged region 150 on the shaft 102 adjacent the threaded lead end 112, that is preferably threaded at a predetermined pitch. The drive end 106 of the cylindrical shaft 102 may include an enlarged drive head 152, preferably including a chamfered slot 154 therein.

Figure 6A:
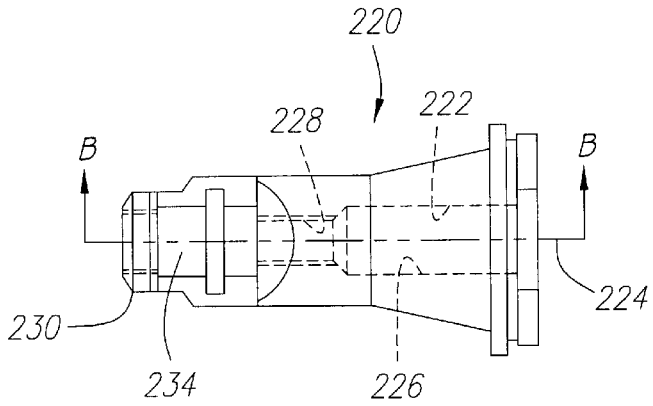
FIG. 6A is a side view of a nozzle for a prewinder tool.
Figure 6B:
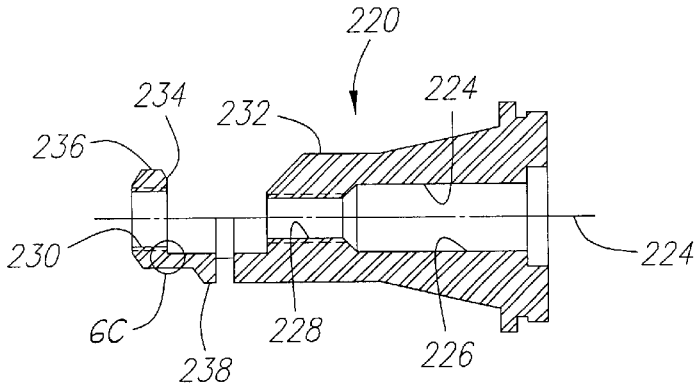
FIG. 6B is a cross-sectional view of the nozzle of FIG. 6A, taken along line B—B.
Figure 6C:
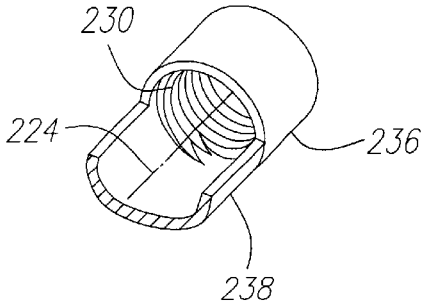
FIG. 6C is a perspective detail of a nozzle head of the nozzle of FIG. 6A.
Figure 7:
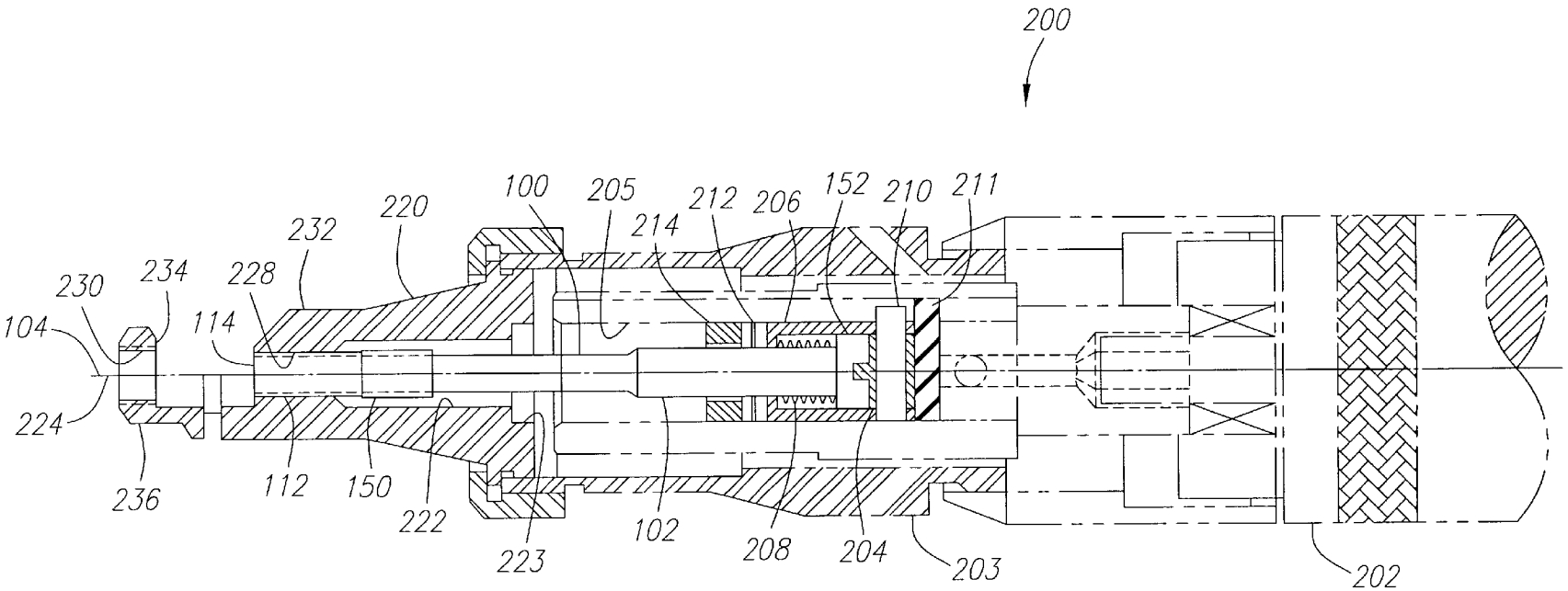
FIG. 7 is a cross-sectional view of a mandrel assembled into pneumatic prewinder tool (in phantom) including a nozzle, in accordance with the present invention.

Turning to FIGS. 5–7, a pneumatic prewinder tool 200 is shown that includes a mandrel 100 therein in accordance with the present invention. The prewinder tool 200 includes an air motor 202 or other drive mechanism (not shown), a tool adapter 203, and a clutch plug 204 for engaging the drive head 152 of the mandrel 100 and transferring rotational forces between the air motor 202 and the mandrel 100. A tool body 206, spring 208 and retainer pin 210 are provided for detachably securing the mandrel 100 to the clutch plug 204. Alternatively, other attachment mechanisms, such as a collet device, may be provided for securing the mandrel 100 to the air motor 202, as will be appreciated by those skilled in the art. For example, in a further alternative, a telescopic drive adapter may be provided for extending the stroke length of the mandrel.

A nozzle 220 is also provided for guiding the mandrel 100 and/or a wire insert (not shown) during use of the prewinder tool 200, the nozzle 220 preferably being detachable from the tool adapter 203. The nozzle 220 has an axial passage 222 therethrough defining an axis 224 substantially coextensive with the longitudinal axis 104 of the mandrel 100. The axial passage 222 is generally cylindrical and preferably includes a first substantially smooth-walled region 226 through which the mandrel 100 may freely pass, and second and third threaded regions 228, 230.

With particular reference to FIGS. 6A–6C, the second threaded region 228 extends through a first nozzle head portion 232, and has a predetermined diameter and thread pattern for cooperating with the threaded enlarged portion 150 of the mandrel 100 for advancing and withdrawing the lead end 112 of the mandrel 100 at a predetermined pitch. The third threaded region 230 extends through a second nozzle head portion 236 and has a predetermined diameter and thread pattern for cooperating with an outer thread of a wire insert once it is received on the lead end 112. A lateral opening 234 is provided between the first and second nozzle head portions 232, 236, thereby defining an arcuate portion 238 for placing a wire insert in axial alignment with the lead end 112 of the mandrel 100.

Returning to FIG. 5, during assembly, a mandrel 100 may be selected that corresponds to the diameter and thread pattern of a desired tapped hole (not shown) into which a helically coiled wire insert (not shown) is to be installed. The drive head 152 may be aligned and coupled to the clutch plug 204, and the tool body 206 and spring 208 aligned and attached to the clutch plug 204 using the retainer pin 210, thereby substantially securing the mandrel 100 to the clutch plug 204.

Turning to FIG. 7, the mandrel 100 and clutch plug 204 may then be directed into a cavity 205 in the tool adapter 203 until the clutch plug 204 substantially engages a drive mechanism (not shown) of the air motor 202, and preferably contacts a mandrel sleeve bumper 211 within the tool adapter 203. A shim washer 212 and a spacer 214 may be advanced over the cylindrical shaft 102 of the mandrel 100 until they abut the tool body 206, and the nozzle 220 attached may be attached to the tool adapter 203. Preferably, the spacer 214 has a preselected length for limiting the travel of the mandrel 100 with respect to the nozzle 220, as explained further below.

The prewinder tool 200 may then be used to install a wire insert into a selected tapped hole. The wire insert generally includes a substantially cylindrical passage therethrough between a first open end and a second end having a tang extending substantially transversely across the passage. More preferably, the wire insert is selected to provide an outer thread pattern for engaging the selected tapped hole and an inner thread pattern for engaging a fastener that may be subsequently introduced into the tapped hole after the wire insert is installed.

The wire insert is placed through the lateral opening 234 between the first and second nozzle head portions 232, 236 and into axial alignment with the mandrel 100 with the open end directed towards the first nozzle head portion 232 and the tanged end towards the second nozzle head portion 236. The mandrel 100 may then be rotated in the forward direction, e.g., counterclockwise, until the enlarged threaded region 150 of the mandrel engages the threaded second region 228 of the first nozzle head portion 232, thereby advancing the lead end 112 of the mandrel forward at a predetermined pitch.

As the lead tip 114 exits the first nozzle head portion 232, the lead tip 114 enters the open end of the wire insert, and the lead end 112 engages the inner thread pattern, preferably compressing the wire insert radially inward. The mandrel 100 may be rotated further, advancing the wire insert over the lead end 112 until the tang on the wire insert is properly seated in the slot 116 in a predetermined orientation. Preferably, when the lead end 112 is advanced through the passage in the wire insert, the tang initially slidably engages the first inclined ramp 140 of the lead tip 114 (see FIG. 4A), which deflects the tang axially away from the lead tip 114 until the predetermined orientation is reached, whereupon the first and second drive edges 130*c*, 132*c* of the lead tip 114 (see FIG. 4B) pick up the tang. The tang may then be seated in the slot 116 in the predetermined orientation, and the wire insert fully received on the lead end 112.

The mandrel 100 may then be rotated forward further, thereby advancing the lead end 112, with the wire insert thereon, through the third threaded region 230 of the second nozzle head portion 236, the thread pattern of the third threaded region 230 substantially engaging the outer thread of the wire insert. The nozzle 220 may be aligned with the tapped hole, and the lead end 112 advanced out of the second nozzle head portion 236 and into the tapped hole, the outer thread of the wire insert substantially engaging the thread pattern of the tapped hole. The mandrel 100 may be advanced forward until the spacer 214 abuts an enlarged recess 223 of the axial passage 222 through the nozzle 220, thereby preventing the mandrel 100 from being advanced further. Preferably, the length of the spacer 214 is selected such that the spacer 214 abuts the enlarged recess 223 when the lead tip 114 of the mandrel 100 reaches the bottom of the tapped hole, thereby preventing the wire insert from being over-driven into the tapped hole.

The direction of the drive mechanism may then be reversed, i.e., the mandrel 100 rotated in the opposite direction, to withdraw the lead end 112 of the mandrel 100 from the tapped hole while leaving the wire insert within the tapped hole. Preferably, when the mandrel 100 is reversed, the tang of the insert slidably engages the second and third inclined ramps 140, 128 of the lead tip 114, thereby facilitating disengagement of the tang from the slot 116 as the lead end 112 is withdrawn from the tapped hole.

Thus, a mandrel in accordance with the present invention may include a plurality of precisely oriented inclined ramps on its lead tip for facilitating the engagement and disengagement of a tang on a wire insert with respect to a slot in the lead tip in a manner that minimizes undesired variations in the forces transferred between the prewinder tool, the mandrel, the nozzle, the wire insert, and/or the tapped hole. Preferably, inclined ramps are provided adjacent both the leading and trailing edges of the slot to define a "double bevel" mandrel. Because of the precise action provided by the inclined ramps, a double bevel mandrel may be more forgiving and allow greater variation in tolerances of the wire insert and/or the tapped hole.

In addition, a double bevel mandrel may provide improved two point contact between the slot of the lead tip and the tang that facilitates the forces acting generally tangentially to the thread, and thereby substantially minimizes the risk of damage to the various parts. Further, the improved force transfer may allow faster installation times to be used, may facilitate the use of high friction materials, and/or may allow special locking torque wire inserts to be installed in a tapped hole that may not be installed easily with conventional prewinder mandrels.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

What is claimed is:

1. A mandrel for a prewinder tool, comprising:

an elongate shaft defining a longitudinal axis and having a threaded first end and a second end;

a slot extending substantially transversely and entirely across the first end, thereby dividing the first end into first and second end portions; and a pair of opposing beveled edges on the first end portion, the beveled edges sloping downward away from each other.

2. The mandrel of claim 1, wherein the slot includes first and second drive edges for engaging a tang of a wire insert received on the first end, the first drive edge being located between the first and second beveled edges, the second drive edge being located on an outer edge of the second end portion.

3. The mandrel of claim 1, wherein the first end portion includes an intermediate surface between the opposing beveled edges defining a plane substantially normal to the longitudinal axis of the elongate shaft.

4. The mandrel of claim 1, wherein the second end portion defines first and second outer edges adjacent the slot, and the second end portion comprises an inclined ramp extending between the first and second outer edges, the inclined ramp being inclined generally into the slot.

5. The mandrel of claim 4, wherein the first outer edge comprises a drive edge for engaging a tang of a wire insert received on the first end, and the inclined ramp is inclined downward from the first outer edge towards the second outer edge.

6. The mandrel of claim 1, further comprising a drive head on the second end of the elongate shaft.

7. The mandrel of claim 1, wherein the elongate shaft includes an enlarged region adjacent the threaded first end.

8. The mandrel of claim 7, wherein the elongate shaft includes a threaded intermediate region adjacent the threaded first end.

9. The mandrel of claim 8, further comprising a nozzle having an axial passage through which the elongate shaft may extend, the axial passage including a threaded region for engaging the threaded intermediate region of the elongate shaft for driving the elongate shaft axially with respect to the nozzle at a predetermined pitch.

10. The mandrel of claim 1, wherein the first end has a predetermined thread pattern and diameter for engaging a thread pattern of a wire insert receivable on the first end, whereby the wire insert is radially compressed as it is received on the first end.

11. A tool for installing a wire insert, the wire insert defining a passage therethrough and including a tang extending substantially transversely across the passage opposite an open end of the passage, the tool comprising:

an elongate shaft having a first threaded end and defining a longitudinal axis;

a drive mechanism for rotating the elongate shaft about the longitudinal axis;

a slot extending substantially transversely and entirely across the first end, thereby dividing the first end into first and second slot portions; and a pair of opposing beveled edges on the first slot portion, the beveled edges sloping downward away from each other.

12. The tool of claim 11, wherein the slot includes first and second drive edges for engaging the tang of a wire insert received on the first end, the first drive edge being located between the first and second beveled edges, the second drive edge being located within the slot on an outer edge of the second slot portion.

13. The tool of claim 11, wherein the first slot portion includes an intermediate surface between the opposing beveled edges defining a plane substantially normal to the longitudinal axis of the elongate shaft.

14. The tool of claim 11, wherein the second slot portion includes first and second outer edges adjacent the slot, and an inclined ramp extending between the first and second outer edges, the ramp being inclined generally into the slot.

15. The tool of claim 11, wherein the elongate shaft is detachable from the drive mechanism.

16. The tool of claim 15, wherein the elongate shaft has a drive head on a second thereof.

17. The tool of claim 16, wherein the drive mechanism and the drive head include cooperating connectors for detachably securing the elongate shaft to the drive mechanism.

18. The tool of claim 11, wherein the drive mechanism is pneumatically powered.

19. The tool of claim 11, wherein the elongate shaft includes an enlarged region adjacent the threaded first end.

20. The tool of claim 19, wherein the elongate shaft includes a threaded intermediate region.

21. The tool of claim 20, further comprising a nozzle extending from the drive mechanism through which the elongate shaft extends.

22. The tool of claim 21, wherein the nozzle includes a threaded region for engaging the threaded intermediate region of the elongate shaft for driving the elongate shaft axially at a predetermined pitch.

23. A mandrel for a prewinder tool comprising:

a cylindrical shaft defining a longitudinal axis and having a threaded first end and a second end defining a drive head for attachment to a prewinder tool;

a slot extending substantially transversely and entirely across the first end, thereby dividing the first end into first and second end portions;

a threaded intermediate region on the cylindrical shaft adjacent the first end;

opposing first and second drive edges on the first and second end portions for engaging a tang of a wire insert when the cylindrical shaft is rotated in a first direction, respectively; and a first inclined ramp edge sloping downward and radially outward away from the second drive edge, the first inclined ramp having a predetermined incline angle such that the tang being received on the first end of the cylindrical shaft is received in the slot in a predetermined orientation when the cylindrical shaft is rotated in the first direction.

24. The mandrel of claim 23, further comprising a first trailing edge on the first end portion, and a second inclined ramp adjacent the first trailing edge for slidably disengaging a tang of a wire insert received in the slot when the cylindrical shaft is rotated in a second direction.

25. The mandrel of claim 24, further comprising a second trailing edge on the second end portion, and a third inclined ramp adjacent the second trailing edge for further slidably disengaging a tang of a wire insert received in the slot when the cylindrical shaft is rotated in the second direction.

* * * * *